United States Patent [19]

Forsterling

[11] Patent Number: 4,532,887

[45] Date of Patent: Aug. 6, 1985

[54] LIFE EXTENSION OF CATALYST PREDIP BATHS

[75] Inventor: Robert B. Forsterling, Kokomo, Ind.

[73] Assignee: General Motors Corporation, Detroit, Mich.

[21] Appl. No.: 623,011

[22] Filed: Jun. 21, 1984

Related U.S. Application Data

[62] Division of Ser. No. 490,313, May 2, 1983, Pat. No. 4,481,231.

[51] Int. Cl.[3] ..... C23C 3/02

[52] U.S. Cl. ..... 118/429; 210/205; 210/207; 427/306

[58] Field of Search ..... 118/429; 210/205, 207

[56] References Cited

U.S. PATENT DOCUMENTS 1,426,141 8/1922 Belke .
1,511,967 10/1924 Holland .
1,981,715 11/1934 Atkinson .
3,562,038 2/1971 Shipley .
3,669,853 6/1972 Beach .
3,694,250 9/1972 Grunwald .
3,819,497 6/1974 Grunwald .
3,865,623 2/1975 Allen .
3,905,827 9/1975 Goffredo .
3,922,208 11/1975 Cordone .

*Primary Examiner*—John D. Smith
*Attorney, Agent, or Firm*—Robert J. Wallace

[57] ABSTRACT

A method and apparatus for extending the useful life of an acqueous acid chloride solution that serves as a protective bath for an activator dip bath such as used in electroless copper plating. Means are provided for recirculating the acidic chloride solution over metallic tin to precipitate copper ions from the solution. The precipitated copper is filtered from the solution to extend its useful life.

1 Claim, 2 Drawing Figures

LIFE EXTENSION OF CATALYST PREDIP BATHS

This patent application is a division of my U.S. patent application Ser. No. 490,313, that was entitled "Life Extension of Catalyst Predip Baths" and was filed on May 2, 1983, now U.S. Pat. No. 4,481, 231.

FIELD OF THE INVENTION

This invention relates to extending the useful life, in a sense reclaiming, a solution contaminated with copper ions. More specifically, it relates to extending the life of an acidic chloride predip bath that precedes soaking in a catalyst bath for electroless plating.

BACKGROUND OF THE INVENTION

To prepare a surface for electroless plating, such as electroless copper plating, one first cleans the surface very thoroughly. The surface is then given a treatment that activates it for subsequent electroless plating, by forming catalytic deposition sites on the surface. Then the copper will deposit electrolessly onto the surface simply by immersion in an appropriate electroless copper plating solution. The activation treatment referred to involves soaking the surface a few minutes in a costly activator solution. The activator solution is normally a colloid of palladium chloride and stannous chloride, that is highly sensitive to oxidizing contaminants and to reduction in its chloride ion concentration. On the other hand such contaminants and water can easily be dragged into the activator bath from prior process steps. Accordingly, one customarily protects the activator bath by first immersing a part to be plated in a less costly, i.e. predip, bath that is specially formulated with hydrochloric acid and sodium chloride. When contaminants detrimental to the activator solution build up in the predip bath, the predip bath is dumped. Thus no significant contaminant concentration is dragged into the activator solution to quickly poison it.

As mentioned, oxidizing agents can poison the activator solution. Peroxides, copper ions in the plus two oxidation state ($Cu^{+2}$), and chromium ions in the plus six oxidation state ($Cr^{+6}$) serve as oxidizing agents in the activator solution.

One may use electroless copper plating to form conductive passages extending between opposed copper plated faces of a resin based electronic circuit board. Such plated passages are sometimes referred to as plated-thru-holes. Part of the cleaning process in making a plated-thru-hole in such a circuit board involves etching the copper faces of the circuit board. Unless thoroughly rinsed, copper ions in the plus two oxidation state can adhere to the face of the circuit board, and be dragged into the activator bath. As mentioned, this can degrade it. Accordingly, immersion in a predip bath is customarily used prior to immersion of the circuit board in the activator bath.

When plating on plastics, the plastic is frequently initially etched in a strong oxidizing solution, as for example chromic acid. Even though one may attempt to rinse off all of the oxidizing agent, i.e. the chromic acid, from the surface, some of it may still adhere to the surface. If the chromium ions are oxidized to the plus six oxidation state, and enough are dragged into the activator bath, they might poison it. Hence, use of a predip bath is important when plating on plastics.

We have found how to render the oxidizing agents in a predip bath less harmful. Thus, we have found a process by which the lifetime of the predip bath can be extended before it must be dumped and replaced. This reduces the overall volume of predip bath that must be dumped, reduces the man hours used and production time lost when rebuilding fresh predip baths, and reduces the cost of constituents used in the predip bath.

OBJECTS AND SUMMARY OF THE INVENTION

It is, therefore, an object of this invention to provide a method for extending the life of a predip bath in an electroless plating process.

Another object of the invention is to reclaim an electroless copper plating predip bath by chemically reducing copper ions in a manner that introduces tin ions for drag-out into a following activator solution.

Another object of the invention is to provide an apparatus for extending the life of a predip bath in an electroless copper plating solution.

The invention comprehends recirculating the predip bath over metallic tin, so as to chemically reduce oxidizing agents therein and introduce tin ions into the bath. Copper ions are reduced to a copper precipitate, which we believe is finely divided pure copper metal. The solution is then filtered to separate the precipitated copper from the predip bath. In a preferred example, we dispose an ingot of tin within a filter bag, such as an anode bag used in electroplating. The ingot and bag are suspended in the predip bath and the predip bath pumped into the bag over the tin. Fine particles of copper are precipitated on the tin and, retained within the filter bag.

BRIEF DESCRIPTION OF THE DRAWINGS

Other objects, features and advantages of the invention will become apparent from the following description of preferred examples thereof and from the drawings, in which.

DESCRIPTION OF THE PREFERRED EMBODIMENTS

We have found our invention to be particularly useful in extending the life of, i.e. reclaiming, the acidic chloride soak solution used as a predip bath in an electroless copper plating process. Such a process is used to plate the walls of holes interconnecting opposite copper coated major faces of a double-sided electronic circuit board. Typically, an electronic circuit board is a sheet of composite material comprising an electrically insulating reinforcing material bound together by an organic resin. In a double-sided circuit board, both major faces of the sheet have a copper layer in the form of copper circuit pattern.

The copper on the opposite faces of the sheet can be placed in low resistance electrical communication with one another by forming a conductive path through the thickness of the circuit board. The conductive path can be formed by first drilling a hole through the thickness of the circuit board, and then coating the walls of the hole with copper. The thus-coated holes are sometimes referred to as plated-thru-holes, as previously mentioned.

Figure 1:
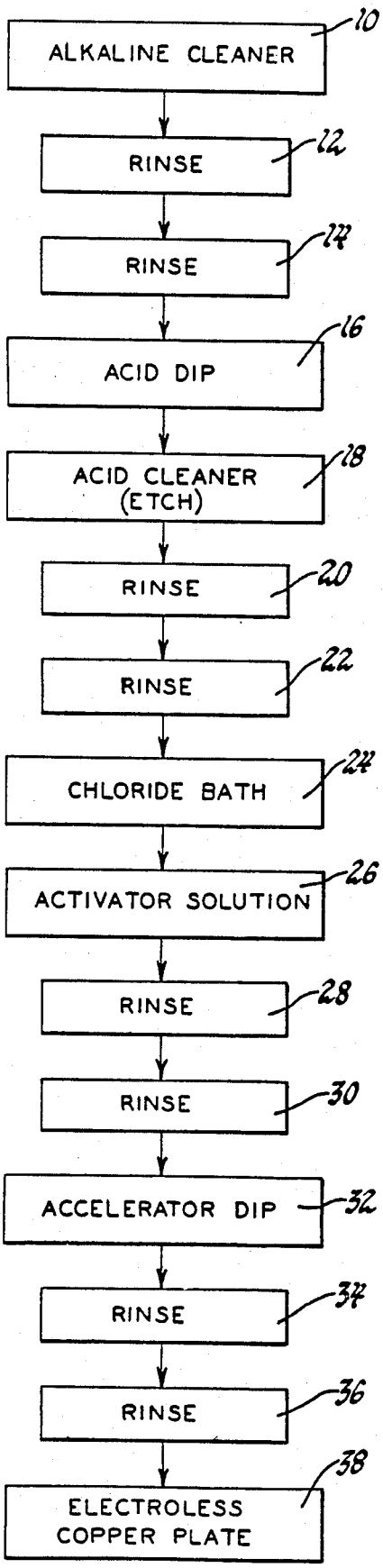
FIG. 1 shows a block diagram of an electroless copper plating process in which this invention can be used.

Reference is now made to FIG. 1 which illustrates the steps used in a typical electroless plating process for forming the plated-thru-holes. After the hole is drilled, it can be deburred by etching. Then the circuit board is placed in an alkaline cleaning solution 10 to remove organic contaminants from the circuit board surface. While the circuit board is immersed in the alkaline cleaner, it is gently moved back and forth in a direction perpendicular the major faces of the circuit board. This not only agitates the bath but also insures that the cleaner flows through the hole that was drilled. In this way, air bubbles are eliminated from the hole and good contact between the solution and the hole walls is provided. It is to be understood that such agitating motion is used when the circuit board is immersed for each treatment or rinse in this process.

The circuit board is then dipped into two successive rinses 12 and 14 of reverse osmosis water. It is then dipped into an aqueous solution 16 containing 10–20% by volume concentrated sulfuric acid. This provides an acid predip solution for dragging into the next following bath 18, which is an acid cleaner. Acid cleaner solution 18 etches the surface of the copper to remove oxides, tarnish, etc. It also removes some copper from the major faces of the circuit board. One solution that can be used contains about 3% by volume hydrogen peroxide, 20% by volume concentrated sulfuric acid and 20 grams per liter of copper sulfate.

The circuit board is then immersed in successive rinses 20 and 22 of reverse osmosis water, and then into an acidic chloride bath 24. The acidic chloride bath 24 is the predip bath previously referred to as the protective bath for the activator solution 26. The acidic chloride bath 24 is an aqueous solution containing some hydrochloric acid and a high concentration of sodium chloride. It may also contain proprietary ingredients, if purchased from a commercial supplier. The high chloride concentration in bath 24 is to insure that the following activator solution, also referred to as a catalyst dip, does not become undesirably diluted by drag-in of water.

After immersion for about one minute in the acidic chloride bath 24, the circuit board is removed and placed directly into the activator solution 26, where it soaks for about five minutes. As mentioned, the catalyst dip bath is essentially a palladium chloride-stannous chloride colloid suspended in an aqueous medium containing hydrochloric acid and sodium chloride. The colloid forms sites on the circuit board, including the hole walls, where copper can subsequently electrolessly deposit. The activator solution is by far the most expensive solution referred to in FIG. 1. Moreover, it is the most sensitive to contamination and degradation, i.e. poisoning. It requires a specific minimum chloride ion concentration and stannous ion concentration. If oxidation contaminates build up too high of a concentration in this solution, it will no longer serve to activate a surface. Hence, it will no longer catalyze electroless deposition on that surface. The predip bath 24 is used to maintain chloride content and minimize drag-in of contaminants.

The circuit board is then rinsed again in the successive rinses 28 and 30 of reverse osmosis water and dipped into accelerator solution 32. This conditions the catalyst deposited on the circuit board surface by the activator solution. The accelerator bath is generally a mild aqueous solution of a fluoroboric acid. After a short immersion in the accelerator solution 32, the circuit board is rinsed twice again by immersion in successive baths 34 and 36 of reverse osmosis water. It is then immersed in an aqueous solution 38 for electrolessly depositing copper. Any of the normal and accepted electroless copper plating solutions can be used.

Ordinarily, in commercial production operations most if not all of the solutions used in the process will be provided by a commercial supplier. In such instance the solutions will generally be proprietary in nature. Nonetheless all the plating systems have a predip bath 24 and activator solution 26 such as generally hereinbefore described.

Figure 2:
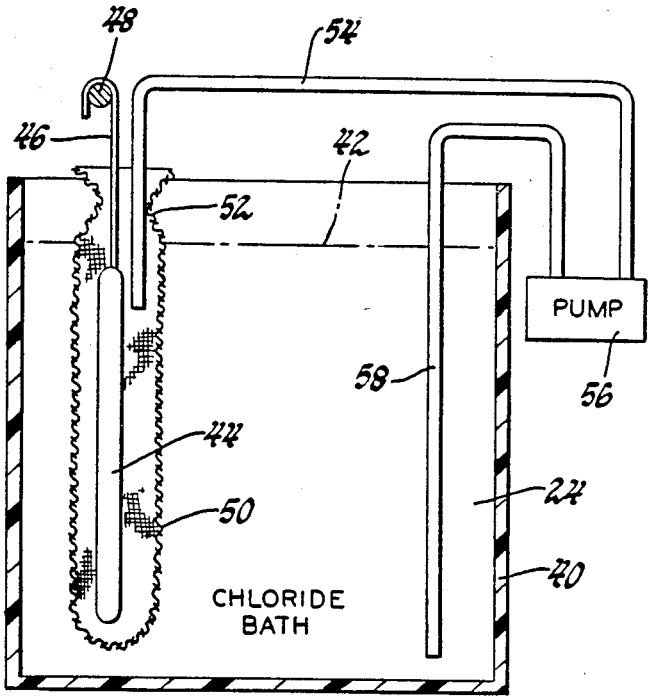
FIG. 2 shows a diagrammatic view in partial section of an apparatus for practicing this invention.

FIG. 2 shows an apparatus for extending the life of the predip bath 24 used to protect the activator solution 26 described above. It shows how an otherwise conventional acidic chloride predip tank is modified in order to practice this invention. The predip bath 24 is disposed within a tank 40 up to a level 42. Also in the tank is an ingot 44 of tin suspended by tungsten hook 46 from a cross bar 48 supported above tank 40. The tin ingot 44 is surrounded by a mesh bag 50. Ingot 44 is preferably of very pure tin metal, as for example it could be an electroplating anode. On the other hand, it may be pure scraps of tin. It may even be desirable to include some pure tin chips, scraps, flakes, etc., in the bag along with the electroplating anode. Since the anode is not electrolyzed in this invention, no connection to a source of electrical potential is provided. The open upper end of bag 50 is closed at 52 by a drawstring (not shown). The solution is circulated into the drawstring bag 50 by means of a pipe 54 extending from a pump 56 which draws solution 24 from tank 40 by means of pipe 58. Preferably solution 24 is continuously recirculated from tank 40 into the bag 50 while the soak solution is being used.

Bag 50 should be a bag which withstands attack from the acidic chloride bath 24 and which has a mesh which provides a maximum opening in the weave of approximately 50 microns. The weave has to be tight enough to prevent the copper-containing particles which precipitate out on the tin metal in the bag 50 from passing through the bag back into the tank 50. Generally, I prefer a mesh providing openings at Dleast about 5 microns in maximum dimension up to about 40 microns in maximum dimension. In practice, it would seem that any of the commercially available electroplating anode bags can be used. They are generally made of a suitable mesh and of fibers such as polypropylene or the like, which will withstand attack by the solution and provide long life.

It should also be recognized that the tin metal could be provided in a cartridge filter assembly rather than being suspended within the tank. Such an assembly would include means for exposing the solution 24 to tin metal upstream from a filter cartridge. On the other hand, this would require a specialized piece of equipment and special handling of the solution and of the filter cartridge. Accordingly, while the tin ingot 44 and bag 50 take up some room in the tank, they are quite conveniently used, serviced and replaced.

The tin apparently produces a displacement reaction in predip bath 24 with copper ions, that effectively reduces the copper ions to free copper and dissolves the tin by forming stannous ions. It should be recognized that stannous ions are an important ingredient in the following activator bath 26 and must be periodically replenished in that bath. When this invention is used, a lesser replenishment is necessary. In other words, in this invention one not only removes the contaminating copper ions from the predip solution but concurrently adds tin ions to the predip solution, which tin ions will eventually be dragged into the activator solution 26. Accordingly, the presence of the tin ions is a desirable addition to the predip bath 24.

It should also be pointed out that the tin ingot will be oxidized by organic oxidants and also by chromium plus six ions. Hence, the tin will serve to remove contaminants in addition to copper ions from the predip bath 24. It should also be recognized that other metals higher on the electromotive series than tin might be satisfactorily used in this invention provided they would be compatible with the activator solution 26. Such compatibility of course will be dependent upon the chemistry of the activator solution 26. However, it should be mentioned that this invention has been successfully practiced with the electroless copper plating processes commercially available from Enthone, Inc., MacDermid, Inc. and Shipley, Inc. Even though the activator solutions and predip baths are proprietary with each of the three foregoing companies, all three still use a palladium chloride-stannous chloride colloid to catalyze the surface for electroless copper plating.

The embodiments of the invention in which an exclusive property or privilege is claimed are defined as follows:

1. In an apparatus for electrolessly depositing copper, which apparatus serially includes a tank containing an acidic chloride activator dip protective solution and a following tank containing a stannous chloride activator dip that precedes a tank containing an electroless copper plating bath, the improvement wherein the first-mentioned tank includes means for extending the useful life of the acidic chloride solution in protecting the activator dip bath prior to electroless copper plating, said life extension means including a metallic tin rod supported within the tank without connection to means for applying an electrical potential to the rod, effective to provide a chemical reaction between the metallic tin rod and undesired copper ions introduced into the first-mentioned tank, a filter bag enclosing the tin rod that entraps chemical reaction products of the undesired copper ions and the metallic tin rod but allows tin ions to pass through, and pump means for recirculating solution from the first-mentioned tank into the filter bag, whereby the undesired copper ions in the acidic chloride solution will precipitate and be trapped within the bag and replaced in the acidic chloride solution by tin ions, so as to permit the acidic chloride solution tank to have an extended useful life in protecting the stannous chloride activator dip tank.

* * * * *